US006856580B2

(12) United States Patent
Eyries

(10) Patent No.: US 6,856,580 B2
(45) Date of Patent: Feb. 15, 2005

(54) NAVAL-HULL MOUNTED SONAR FOR NAVAL SHIP

(75) Inventor: Michel Eyries, La Colle S/Loup (FR)

(73) Assignee: Thales, Paris (FR)

( * ) Notice: Subject to any disclaimer, the term of this patent is extended or adjusted under 35 U.S.C. 154(b) by 0 days.

(21) Appl. No.: 10/433,777

(22) PCT Filed: Nov. 30, 2001

(86) PCT No.: PCT/FR01/03797

§ 371 (c)(1),
(2), (4) Date: Jun. 6, 2003

(87) PCT Pub. No.: WO02/47065

PCT Pub. Date: Jun. 13, 2002

(65) Prior Publication Data

US 2004/0052160 A1 Mar. 18, 2004

(30) Foreign Application Priority Data

Dec. 8, 2000 (FR) ..... 00 15993

(51) Int. Cl.[7] ..... H04R 17/00; G10K 11/00
(52) U.S. Cl. ..... 367/165; 367/155; 367/173
(58) Field of Search ..... 367/141, 153, 367/155, 157, 165, 173; 181/110

(56) References Cited

U.S. PATENT DOCUMENTS

| | | | | |
|---|---|---|---|---|
| 3,141,148 A | | 7/1964 | Hueter | |
| 4,661,938 A | | 4/1987 | Jones et al. | |
| 5,319,612 A | * | 6/1994 | Lemer et al. | 367/153 |
| 5,515,342 A | * | 5/1996 | Stearns et al. | 367/155 |
| 5,898,642 A | * | 4/1999 | Wagner | 367/158 |
| 6,341,661 B1 | * | 1/2002 | Bick et al. | 181/110 |

FOREIGN PATENT DOCUMENTS

DE 36 35 364 A 4/1988

* cited by examiner

*Primary Examiner*—Ian J. Lobo
(74) *Attorney, Agent, or Firm*—Lowe Hauptman Gilman & Berner, LLP

(57) ABSTRACT

The invention relates to hull sonars for a naval vessel. The hull sonar includes associating a transmitter formed by cylindrical rings with a receiver formed by at least two sets of hydrophones distributed over two transparent cylindrical surfaces that are coaxial with the transmitter. Thus, it is possible to reduce the weight and the total volume of the antenna and to compensate for the effect of the quality factor Q.

22 Claims, 1 Drawing Sheet

NAVAL-HULL MOUNTED SONAR FOR NAVAL SHIP

FIELD OF THE INVENTION

The present invention relates to the active sonars which are fitted to the hull of a naval vessel, in particular that of a surface ship or boat.

BACKGROUND OF THE INVENTION

According to the prior art, this type of sonar consists, as represented in FIG. 1, of a cylindrical antenna formed by a support 10 on which columns of transducers 11 are fitted. The transducers are generally of the "Tonpilz" type and carry out both transmission and reception. The antenna is fixed to the hull by using a piece 12 in which tapped holes 120 have been made.

For transmitted frequencies higher than several kHz, typically 5 kHz, such an antenna still has reasonable dimensions and weight. For lower frequencies, between 1 and 2 kHz for example, the antenna becomes too heavy. The quality-factor Q of the transducers furthermore limits the frequency band in this case.

SUMMARY OF THE INVENTION

In order to overcome these drawbacks, the invention provides a hull sonar for a naval vessel, comprising a low-frequency transmission antenna with elevational directionality formed by a stack of piezoelectric rings, principally characterized in that it furthermore comprises a transparent three-dimensional reception antenna formed by at least two sets of omnidirectional hydrophones distributed over two cylindrical surfaces that are concentric and coaxial with the transmission antenna.

According to another aspect, the hydrophones are wideband hydrophones.

According to another aspect, it hull sonar comprises a set of sets of hydrophones on an equal number of cylindrical surfaces that are concentric and coaxial with the transmission antenna.

According to another aspect, the distribution of the hydrophones over the cylindrical surfaces is random.

According to another aspect, the distribution of the hydrophones over the cylindrical surfaces includes gaps.

According to another aspect, the transmission antenna is suspended so as to remain vertical in order to compensate for the rolling and pitching movements of the vessel carrying it.

According to another characteristic aspect, the transmission lobe of the transmission antenna is stabilized electronically.

According to another aspect, the reception signals of the hydrophones are processed electronically so as to form reception channels having the directionality characteristics of a baffled antenna.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description thereof are to be regarded as illustrative in nature, and not as restrictive.

DETAILED DESCRIPTION OF THE INVENTION

The invention combines a specific transmission antenna, formed by prestressed piezoelectric rings, and a specific reception antenna, formed by omnidirectional hydrophones placed on a lightweight structure. It is hence possible to transmit lower frequencies in a smaller volume and with less weight, and to compensate for the effect of the quality factor Q in order to obtain a wide reception band.

Figure 1:
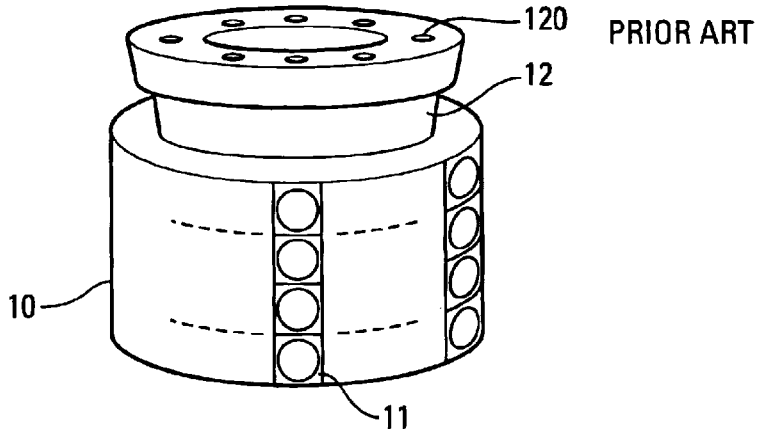
FIG. 1 represents a view or cavalier projection of a known sonar.
Figure 2:
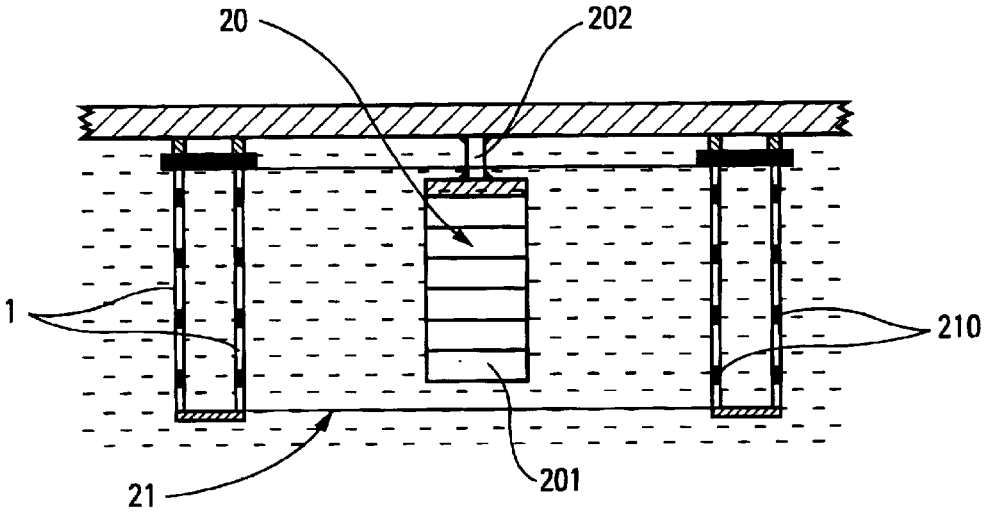
FIG. 2 represents a sectional view of a sonar according to the present invention.

FIG. 2 represents a preferred embodiment of a sonar antenna according to the invention.

The transmission antenna 20 is formed by a stack of piezoelectric rings 201 whose diameter is matched to the transmitted frequency. The description of such a transmission antenna manufactured by using this technique can be found in the French Patent filed by the Applicant on Oct. 03, 1998 under the No 98 02912, published on 17 Sep. 1999 under the No 2 776 161, and granted on 26 Dec. 2000.

Each ring is controlled separately by means of a power amplifier so as to produce a transmission lobe in downward elevation. To this end, the rings are acoustically decoupled, as described for example in the French Patent filed by the Applicant on 14 Oct. 1994 under the No 94 12285, published on 19 Apr. 1996 under the No 2 725 868, and granted on 03 Jan. 1997.

In one embodiment, the transmission frequency is equal to 2.5 kHz and 10 rings with a height of 250 mm are stacked. The width of the elevational lobe is then about 15 degrees and, in order to keep the antenna vertical in spite of the movements of the ship or boat, it is connected to the ship or boat by using a hinged axle 202. A pendulum movement of the antenna is thereby obtained corresponding to the pitch and roll.

According to an alternative embodiment, the transmission lobe is stabilized electrically in a known fashion by varying the phases of the control signals of the rings.

Figure 3:
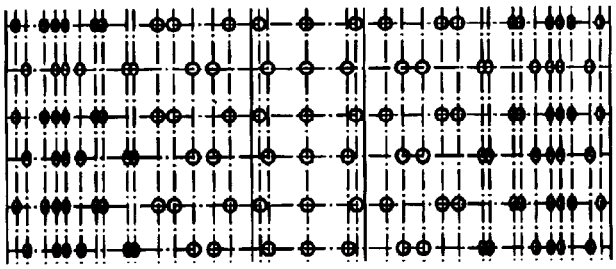
FIG. 3 represents a diagram of the distribution of the hydrophones according to the present invention.

The reception antenna 21 is placed coaxially with the transmission antenna. According to a preferred embodiment, the hydrophones 210 are fixed to a structure 211 that is transparent to the acoustic waves in the frequency band being used. This structure is made of 2 concentric cylinders on which the hydrophones are fixed in columns and in staggered rows, as represented for example in FIG. 3, where the black circles correspond to the hydrophones of the outer cylinder and the white circles correspond to the hydrophones of the inner cylinder.

The hydrophones will advantageously be wideband hydrophones so that the sonar can also function passively (reception from external sources) or multistatically (reception from other transmitters).

In a known fashion, the signals of the hydrophones are processed in order to form channels whose directionality characteristics are those of a baffled antenna. In particular, by processing doublets of hydrophones lying on the same radius, channels having a cardioid directionality are formed, as described in the French Patent tiled by the Applicant on 26 Sep. 1986 under the No 86 13485, published on 01 Apr. 1988 under the No 2 604 530, and granted on 28 Nov. 1988.

According to an alternative embodiment, the arrangement of the hydrophones on the 2 cylindrical supports may be random and/or include gaps (distance of several λ, at the transmission frequency, between the hydrophones).

According to another alternative embodiment, it is possible to use more than two cylinders so as to form a three-dimensional antenna.

Lastly, adaptive processing of the hydrophone signals may be employed in order to reject the noise from the ship or boat.

It will be readily seen by one of ordinary skill in the art that the present invention fulfills all of the objects set forth above. After reading the foregoing specification, one of ordinary skill will be able to affect various changes, substitutions of equivalents and various other aspects of the invention as broadly disclosed herein. It is therefore intended that the protection granted hereon be limited only by the definition contained in the appended claims and equivalents thereof.

What is claimed is:

1. A hull sonar for a naval vessel, including a low-frequency transmission antenna with elevational directionality formed by a stack of piezoelectric rings, comprising:

a transparent three-dimensional reception antenna formed by two sets of omnidirectional hydrophones distributed over two cylindrical surfaces that are concentric and coaxial with the transmission antenna wherein the transmission antenna is suspended so as to remain vertical in order to compensate for the rolling and pitching movements of the vessel carrying it.

2. The sonar as claimed in claim 1, wherein the hydrophones are wideband hydrophones.

3. The sonar as claimed in claim 2, comprises sets of hydrophones on an equal number of cylindrical surfaces that are concentric and coaxial with the transmission antenna.

4. The sonar as claimed in claim 2, wherein the distribution of the hydrophones over the cylindrical surfaces is random.

5. The sonar as claimed in claim 2, wherein the distribution of the hydrophones over the cylindrical surfaces includes gaps.

6. The sonar as claimed in claim 2, wherein the transmission antenna is suspended so as to remain vertical in order to compensate for the rolling and pitching movements of the vessel carrying it.

7. The sonar as claimed in claim 2, wherein the transmission lobe of the transmission antenna is stabilized electronically.

8. The sonar as claimed in claim 1, comprises sets of hydrophones on an equal number of cylindrical surfaces that are concentric and coaxial with the transmission antenna.

9. The sonar as claimed in claim 8, wherein the distribution of the hydrophones over the cylindrical surfaces is random.

10. The sonar as claimed in claim 8, wherein the distribution of the hydrophones over the cylindrical surfaces includes gaps.

11. The sonar as claimed in claim 8, wherein the transmission antenna is suspended so as to remain vertical in order to compensate for the rolling and pitching movements of the vessel carrying it.

12. The sonar as claimed in claim 8, wherein the reception signals of the hydrophones are processed electronically so as to form reception channels having the directionality characteristics of a baffled antenna.

13. The sonar as claimed in claim 1, wherein the distribution of the hydrophones over the cylindrical surfaces is random.

14. The sonar as claimed in claim 13, wherein the distribution of the hydrophones over the cylindrical surfaces includes gaps.

15. The sonar as claimed in claim 13, wherein the transmission antenna is suspended so as to remain vertical in order to compensate for the rolling and pitching movements of the vessel carrying it.

16. The sonar as claimed in claim 1, wherein the distribution of the hydrophones over the cylindrical surfaces includes gaps.

17. The sonar as claimed in claim 1, wherein the transmission lobe of the transmission antenna is stabilized electronically.

18. The sonar as claimed in claim 17, wherein the reception signals of the hydrophones are processed electronically so as to form reception channels having the directionality characteristics of a baffled antenna.

19. The sonar as claimed in claim 1, wherein the reception signals of the hydrophones are processed electronically so as to form reception channels having the directionality characteristics of a baffled antenna.

20. The sonar as claimed in claim 1, wherein the transmission lobe of the transmission antenna is stabilized electronically.

21. The sonar as claimed in claim 1, wherein each reception antenna is formed of a structure that is transparent to the acoustic waves of the transmission antenna.

22. The sonar as claimed in claim 1, wherein each of said two sets of hydrophones is equally radially outwardly spaced from said transmission antenna.

* * * * *